US006592946B2

(12) United States Patent
Nakajima

(10) Patent No.: US 6,592,946 B2
(45) Date of Patent: Jul. 15, 2003

(54) METHOD FOR COATING A HEAT-DEVELOPMENT PHOTO-SENSITIVE MATERIAL HAVING A PHOTO-SENSITIVE LAYER AND A PROTECTIVE LAYER

(75) Inventor: Kenji Nakajima, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/944,588

(22) Filed: Sep. 4, 2001

(65) Prior Publication Data

US 2002/0028298 A1 Mar. 7, 2002

(30) Foreign Application Priority Data

Sep. 4, 2000 (JP) ..... 2000-267545

(51) Int. Cl.[7] ..... B05D 1/30; B05D 1/36

(52) U.S. Cl. ..... 427/419.5; 427/407.1; 427/402; 427/420

(58) Field of Search ..... 427/402, 420, 427/419.5, 407.1; 118/411, DIG. 4

(56) References Cited

U.S. PATENT DOCUMENTS

| | | | | |
|---|---|---|---|---|
| 3,903,843 A | | 9/1975 | Jones | |
| 4,313,980 A | | 2/1982 | Willemsens | |
| 4,828,779 A | * | 5/1989 | Hiraki et al. | 264/171 |
| 5,466,281 A | * | 11/1995 | Hanke et al. | 106/31.38 |
| 5,861,195 A | * | 1/1999 | Bhave et al. | 427/402 |

OTHER PUBLICATIONS

Patent Abstracts of Japan, vol. 1999, No. 9, Jul. 30, 1999 & JP 11 090296 A (Fuji Photo Film Co Ltd), Apr. 6, 1999.

* cited by examiner

*Primary Examiner*—Katherine A. Bareford
(74) *Attorney, Agent, or Firm*—Sughrue Mion, PLLC

(57) ABSTRACT

Each coating liquid is supplied from a first end of each manifold to a second end of the manifold, and pressure loss of each coating liquid flowing through each supply slot becomes smaller from the first end to the second end so as to cancel the pressure loss of the coating liquid flowing through the manifold. Each supply slot becomes shorter from the first end to the second end. This makes the liquid amount uniform along the width of the supply slot (coating width), and thus the layers can be well formed without defects.

1 Claim, 4 Drawing Sheets

METHOD FOR COATING A HEAT-DEVELOPMENT PHOTO-SENSITIVE MATERIAL HAVING A PHOTO-SENSITIVE LAYER AND A PROTECTIVE LAYER

BACKGROUND OF THE INVENTION

1. Field of the Invention

The present invention relates to a coating method and apparatus for a heat-development photo-sensitive material.

2. Description of the Related Art

In the field of medical diagnosis film and photomechanical film, liquid wastes should be reduced from the point of view of environmental protection and space saving. A heat-development photo-sensitive material can be efficiently exposed by a laser image setter or a laser imager, and a high-resolution black image can be formed on it. The heat-development photo-sensitive material does not need solution processing pharmaceuticals to realize a simple environment-protecting heat-development processing system.

The heat-development photo-sensitive material is produced in such a manner that a photo-sensitive layer and a protective layer are formed on a web. The photo-sensitive layer includes organic silver oxide, photo-sensitive silver halide, and hydrophobic polymer latex or the like as a binder, and the protective layer includes at least one water-soluble polymer as a binder. Since viscosity characteristics of the two layers are remarkably different, the layers easily become uneven in thickness and have streaks.

Since the heat-development photo-sensitive material is a new material, a technology for efficiently forming the layers on the continuously-running web and a technology for preventing thickness unevenness of the layers and streaks on the layers have not been established.

In addition, since coating liquids for the layers include organic solvents, the organic solvents in the layers on the web volatilize at the heat developing stage which pollutes the environment. The organic solvents also volatilize at the production of the heat-development photo-sensitive material.

SUMMARY OF THE INVENTION

In view of the foregoing, it is an object of the present invention to provide a coating method and apparatus for efficiently forming a photo-sensitive layer and a protective layer and producing a high-quality heat-development photo-sensitive material without thickness unevenness and streaks. It is also an object of the present invention to provide a coating method and apparatus that does not pollute the environment.

To achieve the above-mentioned object, the present invention is directed to a coating method for a heat-development photo-sensitive material produced in such a manner that at least one photo-sensitive layer including at least one organic silver oxide and at least one hydrophobic polymer latex as binders and at least one protective layer including at least one water-soluble polymer as binders are formed on a web, wherein: coating liquids for the photo-sensitive layer and the protective layer are supplied to manifolds of a slide bead hopper, and pushed out onto a slide surface through supply slots connected to the manifolds to form layers while flowing down the slide surface, and the web that is wound on a back-up roller and continuously running is coated with the layers; and each coating liquid is supplied from a first end of each manifold to a second end of the manifold, and pressure loss of each coating liquid flowing through each supply slot becomes smaller from the first end to the second end to cancel pressure loss of the coating liquid flowing through the manifold.

To achieve the above-mentioned object, the present invention is directed to a coating apparatus for a heat-development photo-sensitive material produced in such a manner that at least one photo-sensitive layer including at least one organic silver oxide and at least one hydrophobic polymer latex as binders and at least one protective layer including at least one water-soluble polymer as binders are formed on a web, wherein: coating liquids for the photo-sensitive layer and the protective layer are supplied to manifolds of a slide bead hopper, and pushed out onto a slide surface through supply slots connected to the manifolds to form layers while flowing down the slide surface, and the web that is wound on a back-up roller and continuously running is coated with the layers; and each coating liquid is supplied from a first end of each manifold to a second end of the manifold, and each supply slot becomes shorter from the first end to the second end.

Since the coating liquid for the photo-sensitive layer does not gel and is thixotropic, it is important how to make the liquid amount uniform along the width of a supply slot (coating width) from which the liquid flows in order to prevent the thickness unevenness and the streaks.

According to the present invention, each coating liquid is supplied from a first end of each manifold to a second end of the manifold, and pressure loss of each coating liquid flowing through each supply slot becomes smaller from the first end to the second end to cancel pressure loss of the coating liquid flowing through the manifold. Each supply slot becomes shorter from the first end to the second end. This makes the liquid amount uniform along the width of the supply slot, and thus the layers can be well formed without defects. There may be one photo-sensitive layer and one protective layer, and there may be two or more photo-sensitive layers and two or more protective layers. There may be an intermediate layer between the photo-sensitive layer and the protective layer.

Moreover, the layers can be well formed even if the solvents of the layers are mainly water. Thus, the organic solvents are not needed, and this does not pollute the environment. The solvent is water means that the concentration of the water in the solvent is 30 percent or higher, preferably 50 percent or higher, more preferably 70 percent or higher, by weight. The other component of the solvent is a water-miscible organic solvent such as methyl alcohol, ethyl alcohol, isopropyl alcohol, methyl cellosolve, ethyl cellosolve, dimethylformamide and ethyl acetate.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
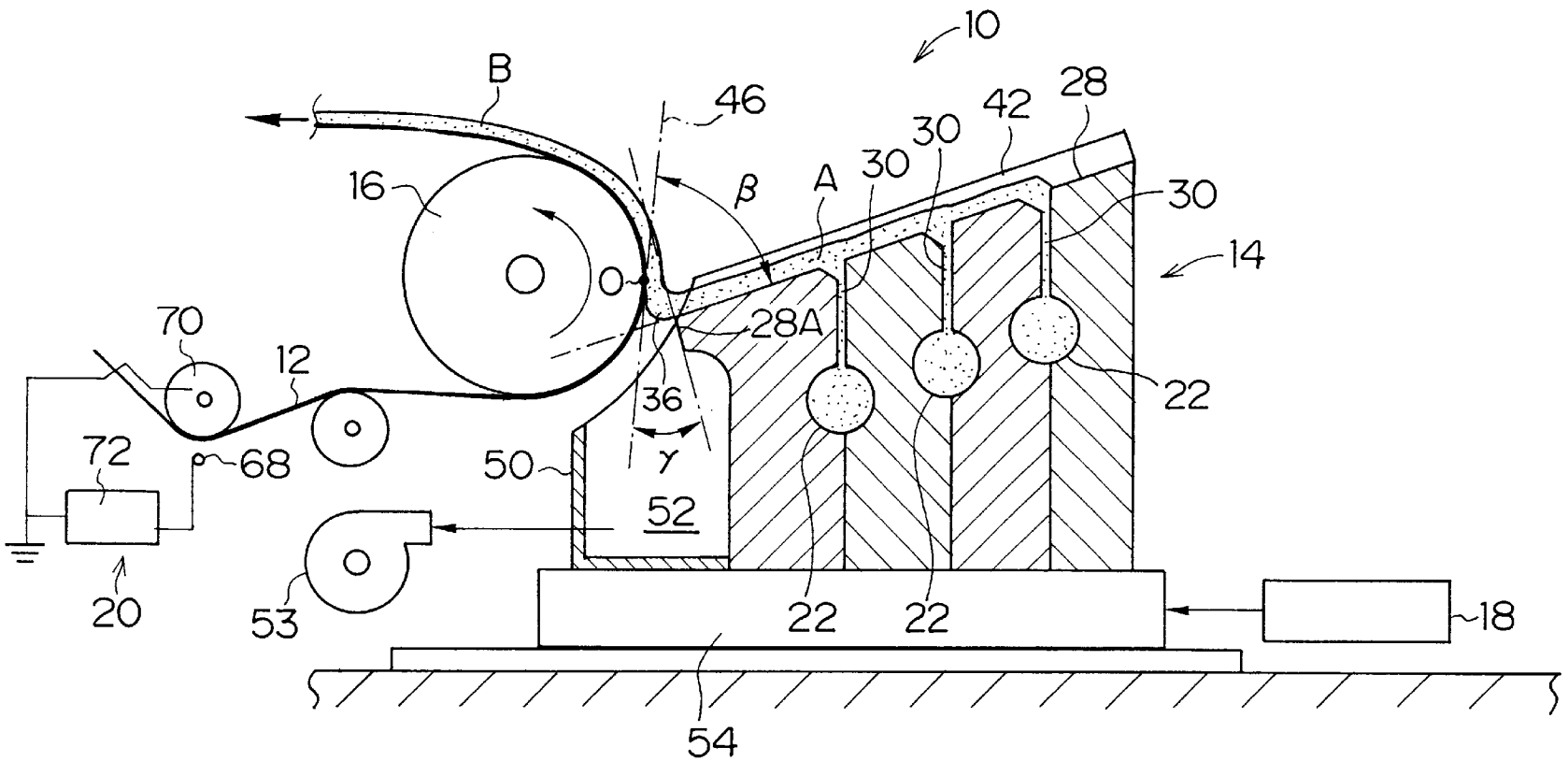
FIG. 1 is a partial section of a coating apparatus for a heat-development photo-sensitive material.

FIG. 1 is a partial section of a coating apparatus 10 for a heat-development photo-sensitive material using a slide bead hopper 14. The heat-development photo-sensitive material is produced in such a manner that one or more photo-sensitive layers including at least one organic silver oxide and at least one hydrophobic polymer latex as binders and at least one protective layer including at least one water-soluble polymer as binders are formed on a web 12. In this embodiment, the web 12 is coated with three coating liquids to form a photo-sensitive layer (bottom layer), an intermediate layer and a protective layer (top layer).

As shown in FIG. 1, the coating apparatus 10 comprises a slide bead hopper 14, a back-up roller 16, a moving mechanism 18 that moves the slide bead hopper 14, and a corona-discharge device 20 that gives electrostatic charge to the web 12.

The slide bead hopper 14 is composed of metal or ceramic blocks fastened with bolts or the like, and it spreads the coating liquids in a coating width direction and pushes them out onto a slide surface. Three manifolds 22 along the coating width direction are provided in the slide bead hopper 14 in parallel, and supply slots 30 are formed between the manifolds 22 and the slide surface 28 inclined to the back-up roller 16. The coating liquids supplied to the manifolds 22 are spread in the coating width direction and pushed out onto the slide surface 28. The coating liquids forms layers A on the slide surface 28 and flow down the slide surface 28. The layers A form a bead 36 at the gap between an end 28A of the slide surface 28 and the web 12 running continuously on the back-up roller 16, and the web 12 is coated with the layers A. The coating liquid for the photo-sensitive layer is supplied to the left manifold 22, and the coating liquid for the intermediate layer is supplied to the middle manifold 22, and the coating liquid for the protective layer is supplied to the right manifold 22. This forms layers B that are the photo-sensitive layer, the intermediate layer and the protective layer on the web 12.

Figure 2:
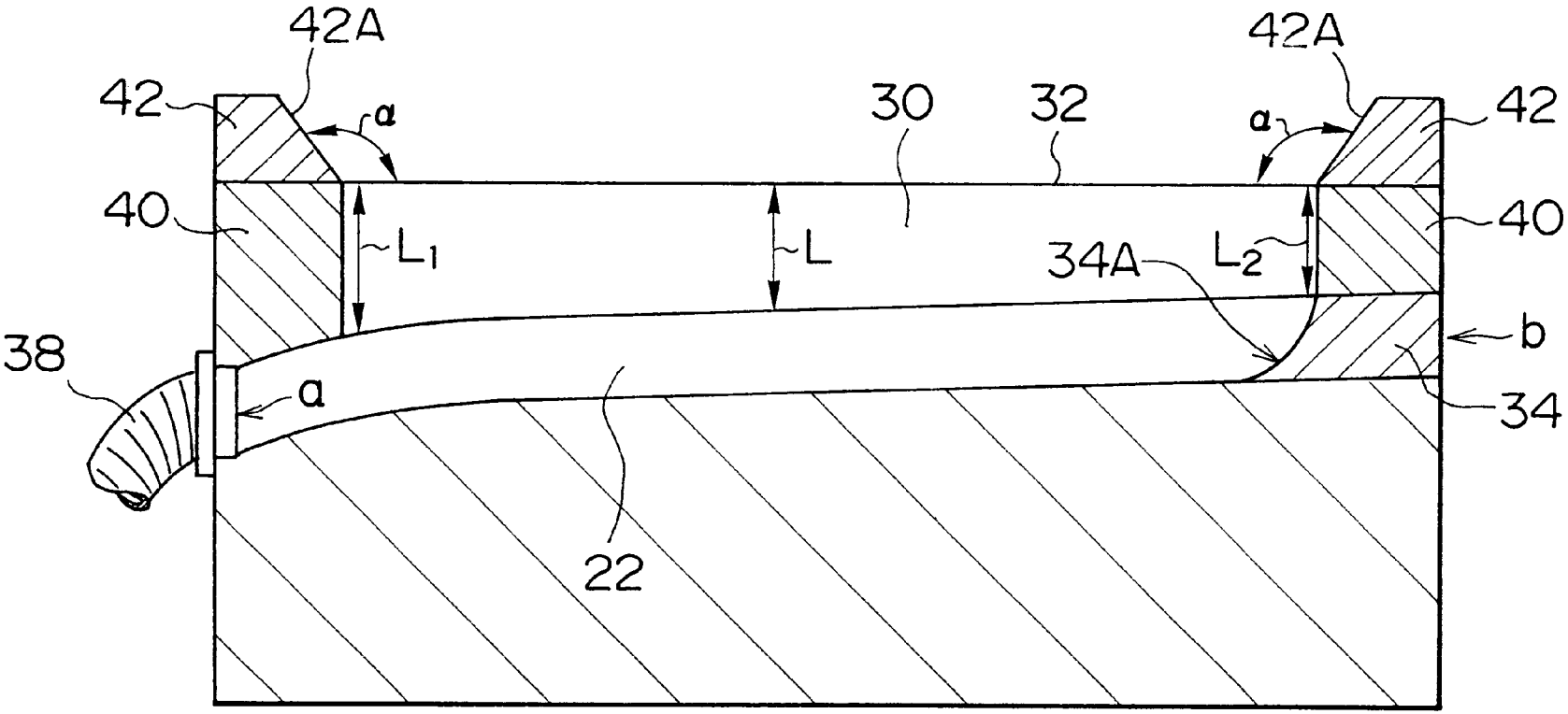
FIG. 2 is a section showing a manifold and a supply slot of a slide bead hopper.
Figure 3:
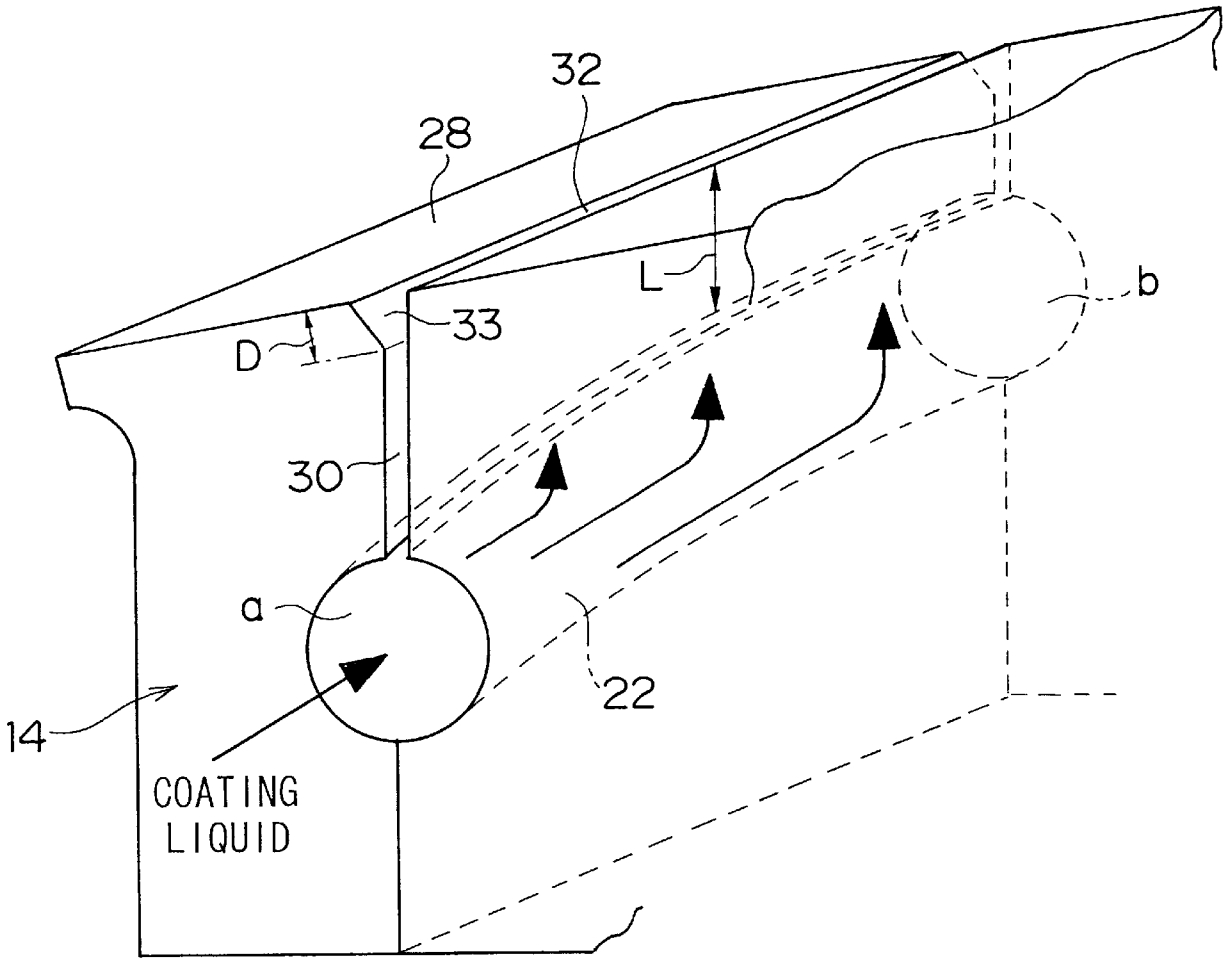
FIG. 3 is a perspective view showing the manifold and the supply slot of the slide bead hopper.

As shown in FIGS. 2 and 3, one of the coating liquids is supplied to one end a of one of the manifolds 22 through a pipe 38, and it flows toward the other end b of the manifold 22. This spreads the coating liquid in the coating width direction. A length L of the supply slot 30 between the manifold 22 and the slide surface 28 becomes smaller from the end a to the end b. Thus, pressure loss of the coating liquid flowing through the supply slot 30 becomes smaller from the end a to the end b, and this cancels pressure loss of the coating liquid flowing through the manifold 22 to make the liquid amount uniform along the width of the supply slot 30. The length L may linearly change from the end a to the end b, but it preferably change quadratically since the liquid amount can be easily uniform along the width of the supply slot 30. The gaps between the supply slots 30 are 0.1 to 1 mm, preferably 0.3 to 0.6 mm. A length $L_1$ of the supply slot 30 at the end a is 30 to 100 mm, and the difference $L_1$–$L_2$ between the length $L_1$ and a length $L_2$ of the supply slot 30 at the end b is 10 mm or less when the coating width is 1 m.

As shown in FIG. 2, the end b of the manifold 22 gradually rises to the right so as to smoothly guide the liquid at the end b to the supply slot 30. This prevents the liquid from piling up at the end b, and further makes the liquid amount uniform along the width of the supply slot 30. A plug 34 with an inclined or curved surface 34A is provided at the end b, and the surface 34A is preferably curved to more smoothly guide the liquid.

As shown in FIG. 3, a broadening part 33 is formed at a supply slot end 32. A length D of the broadening part 33 from the slide surface 28 is 2 to 10 mm, preferably 4 to 8 mm, when the length L of the supply slot 30 is 30 to 100 mm. The maximum width of the broadening part 33 is 1 to 5 mm, preferably 2 to 4 mm. This reduces the velocity (or the pressure) of the liquid being pushed out from the supply slot 30 to the slide surface 28. Thus, the liquid from the downstream supply slot 30 does not disturb the liquid from the upstream supply slot 30 so that the layers A are smoothly formed, and the layers A flow smoothly on the slide surface 28.

As shown in FIG. 2, regulators 40 and 42 are provided on both sides of the supply slot 30 and the slide surface 28, respectively, to regulate the coating width. Surfaces 42A of the regulators 42 are inclined so that an obtuse angle $\alpha$ is formed between each surface 42 and the slide surface 28, and the angle a is 110 to 150 degrees. This prevents the edges of the layers B from being thicker than the middle part of the layers B.

An angle between the slide surface 28 and a perpendicular plane is 60 to 80 degrees. If the angle were smaller than 60 degrees, the layers A would wave and become unstable. If the angle were larger than 80 degrees, the liquid for the photo-sensitive layer with thixotropy would not flow down the slide surface 28.

As shown in FIG. 1, an angle $\beta$ between a tangent 46 to the web 12 and the slide surface 28 at a coating point O where the layers A come in contact with the web 12 is 55 to 85 degrees. If the angle $\beta$ were smaller than 55 degrees, the bead 36 at the gap between the slide bead hopper 14 and the web 12 would largely deform and so-called ribbing would occur to form streaks on the layers B. If the angle $\beta$ were larger than 85 degrees, the coating point O would be on the upper part of the back-up roller 16 and the structure of the coating apparatus 10 would become complicated. In addition, an angle $\gamma$ between the end 28A of the slide surface 28 and the tangent 46 is 20 degrees or smaller. If the angle $\gamma$ were larger than 20 degrees, the bottom of the photo-sensitive layer of the layers A would not be fully in contact with a ridgeline at the top of the end 28A. This would make the thickness of the photo-sensitive layer of the layers B uneven, and form streaks on the layers B.

A balancing surface tension and a dynamic surface tension of the top layer are smaller than those of the intermediate layer, and the surface tensions of the intermediate layer are smaller than those of the bottom layer. This prevents so-called repelling in which the intermediate layer comes over the top layer and the bottom layer comes over the intermediate layer on the slide surface 28 or the web 12 in order to stabilize the layers A and B.

A vacuum chamber 52 enclosed by the slide bead hopper 14, the back-up roller 16 and a chamber member 50 is formed, and connected to a vacuum device 53 or a suction fan. The pressure in the vacuum chamber 52 is reduced less than the atmosphere in order in order to stabilize the bead 36.

The slide bead hopper 14 and the vacuum chamber 52 are provided on a support 54, and the support 54 is moved toward the back-up roller 16 and away from it by the moving mechanism 18. The slide bead hopper 14 moves with the support 54 in the embodiment, but the back-up roller 16 may move instead of the slide bead hopper 14.

Before the web 12 is coated, the corona-discharge device 20 gives the electrostatic charge to at least the coated surface of the web 12. The corona-discharge device 20 is composed of a discharge electrode 68, a grounded roller 70 facing the discharge electrode 68, and a direct-current power source 72 that applies a high voltage between the discharge electrode 68 and the grounded roller 70 for a corona discharge. The coated surface of the web 12 acquires positive or negative electric charge and a potential. The corona-discharge device 20 is used in the embodiment, but a direct-current high voltage may be applied to the back-up roller 16 to apply an electrostatic field to the bead 36. In this case, the back-up roller 16 is not grounded and is coated with an insulator.

Figure 4:
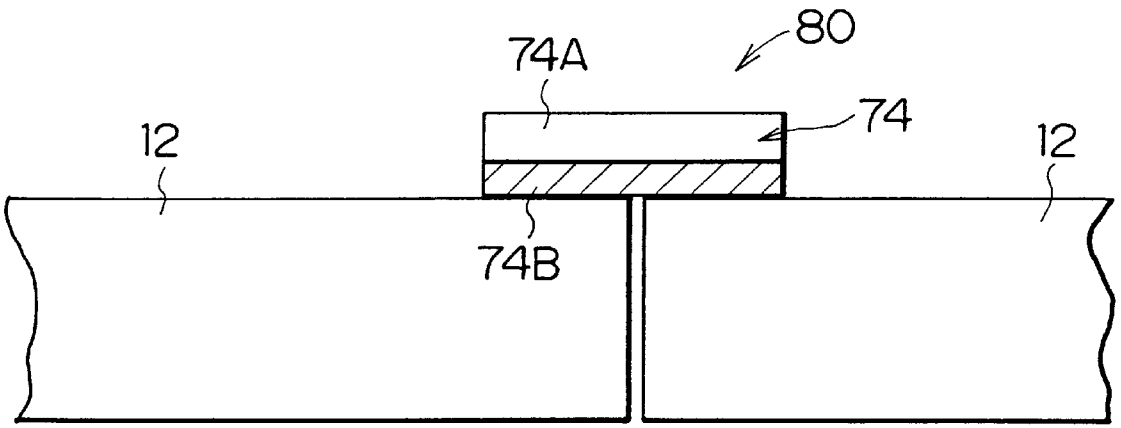
FIGS. 4(*a*) and 4(*b*) are side views showing webs spliced with adhesive tape for splice.
Figure 4:
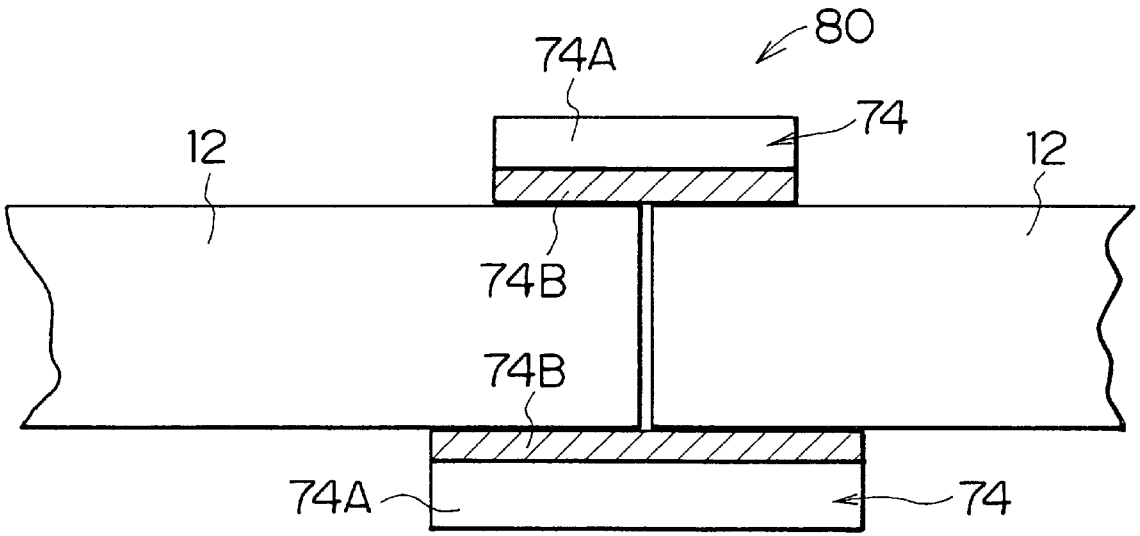

The layers B are thicker at the start of the coating than they are during the coating since the web 12 is coated with the layers A that have flown down the slide surface 28. As shown in FIGS. 4(*a*) and 4(*b*), the currently-coated web 12 is butt-spliced to the next web 12 with one or two pieces of an adhesive tape for splice 74. When a splice 80 passes the gap between the slide bead hopper 14 and the back-up roller 16, the bead 36 between the end 28A and the web 12 largely moves due to the drastic change of the gap between the end 28A and the web 12. As a result, the web 12 can not be coated or can be overcoated.

To address this problem, the pressure in the vacuum chamber 52 is decreased, or the coated surface of the web 12 is given electrostatic charge just before the coating, or a direct-current high voltage is applied to the back-up roller 16 to apply an electrostatic field to the bead 36.

In the first method, the pressure in the vacuum chamber 52 is reduced before the coating below that during the coating, and the pressure is gradually increased when the bead 36 is formed at the start of the coating.

If the web 12 has the splice 80, the pressure in the vacuum chamber 52 is reduced below that during the coating just before the splice 80 arrives at the gap between the end 28*a* and the back-up roller 16, and the pressure in the vacuum chamber 52 is gradually increased to that during the coating after the splice 80 passes the gap.

In the third method, the potential of the surface of the web 12 on the back-up roller 16 is 500 to 2000 V. The back-up roller 16 needs to be ungrounded and coated with an insulating ceramic such as alumina.

To prevent the overcoating at the start of the coating, the slide bead hopper 14 is relatively moved toward the back-up roller 16 after the layers A are formed on the slide surface 28, and the movement velocity is decreased just before the coating.

To prevent the drastic change of the gap between the slide bead hopper 14 and the web 12 when the splice 80 passes it, the slide bead hopper 14 is relatively moved away from the back-up roller 16 a short distance (for example, the thickness of the adhesive tape for splice 74 not to break the bead 36) to widen the gap just before the splice 80 passes the gap, and slide bead hopper 14 is relatively returned toward the back-up roller 16 after the splice 80 passes the gap.

The adhesive tape for splice 74 prevents penetration of the liquids into between the webs 12. The adhesive tape for splice 74 is composed of a substrate 74A made from a plastic or the like and an adhesive 74B. The adhesive tape for splice 74 is 100 $\mu$m or smaller in thickness, and 100 mm or smaller in length. When the both sides of the webs 12 are to be coated, the two pieces of the adhesive tape for splice 74 are attached on the both sides of the webs 12. In addition, the length of the two pieces are different as shown in FIG. 4(*b*) to prevent drastic changes of the thickness of the splice 80.

The photo-sensitive layer of the heat-development photo-sensitive material will now be explained.

The organic silver oxide is an organic substance including a source that can reduce silver ions. Preferably, it is silver salt of organic carboxylic acid, and more preferably silver salt of long aliphatic carboxylic acid (carbon number is 10 to 30, preferably 15 to 28). The concentration of the silver supply substance in the photo-sensitive layer is 5 to 70 percent by weight. The organic silver oxide is not limited to the silver salt of the aliphatic carboxylic acid and silver salt of aromatic carboxylic acid. The silver salt of the aliphatic carboxylic acid is silver behenate, silver arachidonate, silver stearate, silver oleate, silver laurate, silver caproate, silver myristate, silver palmitate, sliver maleate, silver fumarate, silver tartarate, silver linoleate, silver butyrate, silver camphorate, or a compound of two or more of them.

The organic silver oxide is not limited to those described above.

The organic silver oxide is demineralized in a filtration including centrifugal filtration, suction filtration, ultrafiltration and floc condensation method. The demineralization method is not limited to them.

The organic silver oxide is dispersed by a dispersing agent to produce solid fine grains without flocculation. The organic silver oxide is mechanically dispersed with a ball mill, a vibrating ball mill, a planet ball mill, a sand mill, a colloid mill, a jet mill, a roller mill, a high-pressure homogenizer, or the like. The high-pressure homogenizer is preferably used.

At this time, synthetic anionic polymer such as polyacrylic acid, copolyacrylic acid, copolymaleic acid, monoestercopolymaleic acid and acryloylmethylpropanesulfonic acid, semisynthetic anionic polymer such as carboxymethyl starch and carboxymethyl cellulose, anionic polymer such as alginic acid and pectic acid, an anionic surfactant described in Japanese Patent Provisional Publication No. 52-92716 and WO88/04794, a compound described in Japanese Patent Provisional Publication No. 7-350753, anionic, nonioc and cationic surfactants, polymers such as polyvinyl alcohol, polyvinyl pyrrolidone, carboxymethyl cellulose, hydroxypropyl cellulose and hydroxypropylmethyl cellulose, and polymers in the natural world such as gelatin.

The amount of the silver oxide is determined so that the amount of silver in the heat development material is 0.1 to 5 g, preferably 1 to 3 g, per square meter. The amount of the silver oxide is not limited to this.

Photo-sensitive silver halide is used with the organic silver oxide.

The photo-sensitive silver halide is produced in a method described in Research Disclosure No. 17029 (May, 1978) and U.S. Pat. No. 3700458. Halide compound is added to the organic silver oxide to convert a part of the silver of the organic silver oxide into the photo-sensitive silver halide, or silver supply compound and halogen supply compound are added to gelatin or a polymer solution. The latter method is preferably used. A grain of the photo-sensitive silver halide needs to be small to prevent the photo-sensitive material from becoming clouded after the image forming, and its grain size is 0.20 $\mu$m or smaller, preferably 0.01 to 0.15 $\mu$m, more preferably 0.02 to 0.12 $\mu$m. The grain size is a length of a ridgeline of the grain when the grain is a cube or an octahedron, and it is a diameter of a circle that has the same area as its main surface when the grain is plate-shaped. The grain is preferably the cube or plate-shaped. If the grain is plate-shaped, its aspect ratio is 100:1 to 2:1, preferably 50:1 to 3:1. The photo-sensitive silver halide is silver chloride, silver chlorobromide, silver bromide, silver iodobromide, silver iodochlorobromide or silver iodide. It is preferably silver bromide or silver iodobromide, but more preferably is silver iodobromide. The concentration of silver iodobromide is 0.1 to 40 percent by mole, preferably 0.1 to 20 percent by mole.

The photo-sensitive silver halide has at least one type of complexes of metals such as rhodium, rhenium, ruthenium, osmium, iridium, cobalt, mercury and iron. It has one type of metal complexes, or two or more types of one or more metals. The amount of the metal complexes is 1 nmol to 10 mmol, preferably 10 nmol to 100 $\mu$mol, with respect to silver of 1 mol. The structure of the metal complexes is described in Japanese Patent Provisional Publication No. 7-225449. Hexacyano metal complexes of cobalt or iron such as ferricyanic acid ions, ferrocyanic acid ions and hexacyanocobalt acid ions can be used. The hexacyano metal complexes are not limited to them. The metal complexes are evenly contained in the silver halide, or concentrated in its core or shell.

The grains of the photo-sensitive silver halide are chemically sensitized in sulfur sensitization, selenium sensitization or tellurium sensitization. Noble metal sensitization with compounds of noble metals such as gold, platinum, palladium and iridium or reduction sensitization may be used. The concentration of the photo-sensitive silver halide in the organic silver oxide is 1 to 50 percent by mole, preferably 2 to 30 percent by mole, more preferably 3 to 25 percent by mole.

The reductant for the organic silver oxide is any substance that changes a silver ion to metal silver, and it is preferably organic. Photo developing agents such as phenidone, hydroquinone and catechol can be used, but hindered phenol reductant is preferably used. The amount of the reductant is 0.05 to 0.5 mole, preferably 0.1 to 0.4 mole, with respect to silver of 1 mol in the photo-sensitive layer. The reductant can be added to any layer. If the reducing layer is added to a layer other than the photo-sensitive layer, its amount is 0.1 to 0.5 mole with respect to silver of 1 mol. The reductant may be a so-called precursor that functions only at the developing.

Various reductants are described in Japanese Patent Provisional Publication Nos. 46-6074, 47-1238, 47-33621, 49-46427, 49-115540, 50-14334, 50-36110, 50-147711, 51-32632, 51-1023721, 51-32324, 51-51933, 52-84727, 55-108654, 56-146133, 57-82828, 57-82829 and 6-3793, U.S. Pat. Nos. 3,667,958, 3,679,426, 3,751,252, 3,751,255, 3,761,270, 3,782,949, 3,839,048, 3,928,686 and 5,464,738, German Patent No. 2321328 and European Patent No. 692732.

The reductant can be added as a solution, powder, dispersed solid fine grains, or the like. The dispersion is performed with a ball mill, a vibrating ball mill, a sand mill, a colloid mill, a jet mill, a roller mill, or the like. A dispersing agent may be used at this time.

A color tone agent for raising optical densities is also added in order to improve image quality. The color tone agent is effective for forming a black silver image. The amount of the color tone agent is 0.001 to 0.5 mole, preferably 0.005 to 0.2 mole, with respect to silver of 1 mol in the photo-sensitive layer. The color tone agent may be a so-called precursor that functions only at the developing.

Various color tone agents are described in Japanese Patent Provisional Publication Nos. 46-6077, 47-10282, 49-5019, 49-5020, 49-91215, 50-2524, 50-32927, 50-67132, 50-67641, 50-114217, 51-3223, 51-27923, 52-14788, 52-99813, 53-1020, 53-76020, 54-156524, 54-156525, 61-183642 and 4-56849, Japanese Patent Publication Nos. 49-10727 and 54-20333, U.S. Pat. Nos. 3,080,254, 3,446,648, 3,782,941, 4,123,282 and 4,510,236, British Patent No. 1380795 and Belgian Patent No. 841910.

The color tone agent can be added as a solution, powder, dispersed solid fine grains, or the like. The dispersion is performed with a ball mill, a vibrating ball mill, a sand mill, a colloid mill, a jet mill, a roller mill, or the like. A dispersing agent may be used at this time.

The photo-sensitive layer includes the hydrophobic polymer latex in the binder, and the concentration of the polymer latex in the binder is 50 percent or higher by weight. The polymer latex is described in Synthetic Resin Emulsion (1978, edited by Taira Okuda and Kan Inagaki, and published by the Macromolecule Publishing Association), Application of Synthetic Latex (1993, edited by Takaaki Sugimura, Yasuo kataoka, Soichi Suzuki and Keiji Kasahara, and published by the Macromolecule Publishing Association), Chemistry of Synthetic Latex (1970, written by Soichi Muroi, and published by the Macromolecule Publishing Association), and so on.

The polymer latex is homogeneous polymer latex or so-called core/shell type polymer latex. In case of the core/shell type polymer latex, glass transition temperatures of the core and the shell can be different.

The minimum filming temperature (MFT) of the polymer latex is −30 to 90 degrees Celsius, preferably 0 to 70 degrees Celsius. A filming agent may be added to lower the minimum filming temperature, and it is an organic compound (normally, an organic solvent) that is also called a plasticizer. The filming agent is described in Chemistry of Synthetic Latex (1970, written by Soichi Muroi, and published by the Macromolecule Publishing Association).

The polymer for the polymer latex is a polyacrylic resin, a polyvinyl acetate resin, a polyester resin, a polyurethane resin, a gum resin, a polyvinylchloride resin, a polyvinylidene chloride resin, a polyolefin resin, or a copolymer of two or more of them.

The polymer is a straight chain polymer, a branched polymer or a cross-linked polymer. The polymer is a homopolymer composed of monomers one type, or a copolymer composed of monomers of two or more types.

The copolymer is a random copolymer or a block copolymer. The molecular weight is 5000 to 1000000, preferably 10000 to 100000. If the molecular weight were too small, intensity of the photo-sensitive layer would not be enough. If the molecular weight were too large, the film would not be well formed.

The equilibrium moisture content of the polymer of the polymer latex is 2 percent or lower by weight, preferably 1 percent or lower by weight, at the temperature of 25 degrees Celsius and the humidity of 60 percent. There is no minimum of the equilibrium moisture content, but it is preferably 0.01 percent by weight, more preferably 0.03 percent by weight. The definition and measurement methods of the equilibrium moisture content are described in Macromolecule Engineering Course No. 14, Macromolecule Material Testing Method (edited by the Macromolecule Society, and published by Chijinshokan), and so on.

The polymer latex is, for example, a latex of methylmethacrylate, ethylacrylate or methacrylic acid copolymer, a latex of methylmethacrylate, 2-ethylhexylacrylate, styrene or acrylic acid copolymer, a latex of styrene, butadiene or acrylic acid copolymer, a latex of styrene, butadiene, divinylbenzene or methacrylic acid copolymer, and a latex of methylmethacrylate, ethylacrylate, acrylonitrile or methacrylic acid copolymer.

Polymers of only one type are used, or polymers of two or more types are used. The concentration of the polymer latex in the binder of the photo-sensitive layer is 50 percent or higher by weight, preferably 70 percent or higher by weight.

Water-soluble polymers such as gelatin, polyvinyl alcohol, methyl cellulose, hydroxypropyl cellulose, carboxymethyl cellulose and hydroxypropylmethyl cellulose may be added to the photo-sensitive layer so that the concentration of the water-soluble polymers in the binder of the photo-sensitive layer is 50 percent or lower by weight, preferably 30 percent or lower by weight.

The amount of the binder in the photo-sensitive layer is 0.2 to 30 g, preferably 1 to 15 g, per square meter. The photo-sensitive layer is thixotropic, and its viscosity at the shear rate of 0.1/s is 300 to 30000 mPa•s, and its viscosity at the shear rate of 1000/s is 1 to 100 mPa•s. At this time, an RFS Fluids Spectrometer made by the Rheometrix Co., Ltd. is used at the temperature of 25 degrees Celsius.

A photo-sensitizing dye, a reductant, a color tone agent, an anti-fogging agent and the like may be added to the photo-sensitive layer. Also, a dye for adjusting the color tone, a cross-linking agent, a surfactant for improving the coating, and the like may be added to the photo-sensitive layer.

The photo-sensitizing dye spectrosensitizes the silver halide grains in a desired wave length area when it is adsorbed by the silver halide grains. The photo-sensitizing dye is, for example, a cyanine dyestuff, a merocyanine dyestuff, a complex cyanine, a complex merocyanine dyestuff, a holopolarcyanine dyestuff, a styryl dyestuff, a hemicyanine dyestuff, an oxonol dyestuff and a hemioxonol dyestuff. The photo-sensitizing dye is described in Research Disclosure (December, 1978), page 23, Item 17643IV-A, Research Disclosure (August, 1979), page 437, Item 1831X, and their references.

Polymers for the intermediate layer do not cause an aggregation and drastically increase the viscosity when being mixed with the organic silver oxide with the polymer latex as the binder. The polymers for the intermediate layer are preferably nonionic water-soluble polymers.

The nonionic water-soluble polymers are, for example, polyvinyl alcohol, polyvinyl alcohol derivative, polyacrylamide, dextran, polyethylene glycol, and a block copolymer of polyethylene glycol and polypropylene glycol. It is preferably polyvinyl alcohol or polyvinyl alcohol derivative, and more preferably polyvinyl alcohol.

The saponification rate of polyvinyl alcohol is 80 to 99.9 percent, and its polymerization degree is 300 to 2400.

The amount of the polymers for the intermediate layer is 0.1 to 3.0 g, preferably 0.2 to 2.0 g, with respect to the heat-development material of 1 $m^2$ when the intermediate layer is dry. If the amount were too small, the intermediate layer could not prevent the aggregation of polymer latex or organic silver oxide in photo-sensitive layer. If the amount were too large, the adhesion between the photo-sensitive layer and the protective layer would be poor.

The solvent of the coating liquid of the intermediate layer is water, and a little water-miscible organic solvent may be included in the water. The concentration of the water in the solvent is 30 percent or higher, preferably 50 percent or higher, more preferably 70 percent or higher, by weight. The concentration of the polymers in the liquid is 2 to 20 percent by weight, and the amount of the liquid is 2 to 30 ml with respect to the heat-development material of 1 $m^2$ when the layer is wet, and the viscosity of the liquid is 5 to 200 mPa•s. The viscosity is measured with a B-type viscosimeter made by Tokyo Keiki Co., Ltd. at the temperature of 40 degrees Celsius.

Various addition agents may be added to the intermediate layer. The addition agents are color tone agents, anti-fogging agents, and so on, and they are, for example, phthalazine and ammonium phthalate.

A binder of the protective layer is gelatin, polyvinyl alcohol, hydroxypropyl cellulose, methyl cellulose, hydroxypropylmethyl cellulose, hydroxyethyl cellulose, carboxymethyl cellulose, polyacrylamide or dextran.

Gelatin is preferably used in order to prevent unevenness of the layer caused by drying wind, because the photo-sensitive layer does not gel. Delimed gelatin that has a high gelling velocity is especially preferable.

Two protective layers may be formed. In this case, the lower protective layer has an ultra violet absorption agent and/or a hydrophobic polymer latex, and the upper protective layer has a mat agent. An addition agent such as a color tone agent, a layer pH adjusting agent and a hardening agent may be added to the protective layers.

The amount of the binder in each protective layer is 0.1 to 3.0 g, preferably 0.2 to 2.0 g, with respect to the heat-development material of 1 $m^2$. The viscosity of each liquid is 5 to 100 mPa•s, preferably 10 to 50 mPa•s, at the temperature of 40 degrees Celsius.

Any anti-adhesion agent can be used for the upper protective layer. The anti-adhesion agent is, for example, wax, silica grains, elastomeric block copolymer with styrene (for example, styrene-butadiene-styrene, and styrene-isoprene-styrene), cellulose acetate, cellulose acetatebutylete, cellulose propionate, and a compound of two or more of them.

The solvent is water means that the concentration of the water in the solvent is 30 percent or higher, preferably 50 percent or higher, more preferably 70 percent or higher, by weight. The other component of the solvent is a water-miscible organic solvent such as methyl alcohol, ethyl alcohol, isopropyl alcohol, methyl cellosolve, ethyl cellosolve, dimethylformamide and ethyl acetate.

As set forth hereinabove, according to the coating method and apparatus for the heat-development photo-sensitive material, the photo-sensitive layer and the protective layer can be efficiently formed, and the high-quality heat-development photo-sensitive material can be produced without the unevenness of thickness of the layers and the streaks on the layers.

In addition, the layers are well formed even if the solvents of the layers are mainly water. Thus, the organic solvents are not needed, and this does not pollute the environment.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method for a heat-development photo-sensitive material produced in such a manner that at least one photo-sensitive layer including at least one organic silver oxide and at least one hydrophobic polymer latex as binders and at least one protective layer including at least one water-soluble polymer as binders are formed on a web, wherein:

coating liquids for the photo-sensitive layer and the protective layer are supplied to manifolds of a slide bead hopper, and pushed out onto a slide surface through supply slots connected to the manifolds to form layers while flowing down the slide surface, and the web that is wound on a back-up roller and continuously running is coated with the layers, wherein said coating liquid for the photo-sensitive layer is thixotropic; and each coating liquid is supplied from a first end of each manifold to a second end of the manifold, and pressure loss of each coating liquid flowing through each supply slot becomes smaller from the first end to the second end to cancel pressure loss of the coating liquid flowing through the manifold, wherein lengths of the supply slots from the first end to the second end of the manifold are varied to form a quadratic curve.

* * * * *